United States Patent [19]

Arnold

[11] 4,083,417

[45] Apr. 11, 1978

[54] JETTING APPARATUS

[76] Inventor: James F. Arnold, 241 Kilts Dr., Houston, Tex. 77024

[21] Appl. No.: 741,241

[22] Filed: Nov. 12, 1976

[51] Int. Cl.[2] ..... E21C 15/00

[52] U.S. Cl. ..... 175/393; 175/339

[58] Field of Search ..... 175/393, 100, 339

[56] References Cited

U.S. PATENT DOCUMENTS

| | | | |
|---|---|---|---|
| 2,324,956 | 7/1943 | Sewell | 175/100 |
| 2,485,098 | 10/1949 | Johnson | 175/393 |
| 2,643,094 | 6/1953 | Peter | 175/339 |
| 2,765,146 | 10/1956 | Williams, Jr. | 175/393 |
| 2,776,115 | 1/1957 | Williams, Jr. | 175/339 |
| 3,111,179 | 11/1963 | Albers et al. | 175/340 |

*Primary Examiner*—James A. Leppink

[57] ABSTRACT

A jetting apparatus is provided to be a part of a drill string used in drilling a well. The apparatus functions to reduce the hydrostatic pressure of the drilling mud on the bottom of the hole to approach or attain optimal drilling conditions. The apparatus has a body with a plurality of upwardly facing shoulders. A jet nozzle is placed in each of the shoulders to direct or discharge mud vertically upwardly along and parallel to the lower part of the drill string to provide a jet lifting action which reduces the hydrostatic mud pressure on the bottom of the bore hole.

6 Claims, 5 Drawing Figures

JETTING APPARATUS

This invention relates to an apparatus for reducing the hydrostatic pressure of a drilling mud on the bottom of a bore hole being drilled.

During the rotary drilling of oil, gas and other wells, a drilling mud is almost universally used. This mud has several functions, not the least of which is to maintain a hydrostatic pressure on the walls of the bore hole to maintain the hole stability and to prevent the intrusion of formation fluids into the bore hole during its drilling. To this end, the specific gravity or weight of the mud is adjusted by the addition of heavy weighting materials, such as barite, in order that it can exert the proper hydrostatic pressure on the walls of the bore hole. The drilling mud will also inevitably exert hydrostatic pressure on the bottom face of the bore hole where the bit is operating. In certain situations, this can cause less than optimum drilling conditions.

Thus, it is known that the weight of the drilling mud, or its hydrostatic head, acting on the bottom of the bore hole, can have a substantial effect upon the penetration rate of the drill bit. Thus, the maximum drilling efficiency is frequently obtained under balanced pressure conditions, that is, when the hydrostatic pressure of the drilling mud approximates or is equal to the pore pressure of the formation being drilled. In some instances, upper hole conditions dictate a heavier mud be used than is required to balance the pore pressure at the bottom of the hole. For example, it is frequently necessary to run a high weight mud in the hole to combat formation heave in drilling below shale deposits. In such a situation, the hydrostatic pressure of the mud greatly exceeds the pore pressure of the formation being drilled with the result that the bit teeth are attempting to cut through a compacted, hardened surface zone at the bore hole bottom.

It is an object of this invention to provide an apparatus which can be positioned adjacent the bottom of the bore hole to direct a plurality of jets of drilling mud upwardly parallel to the drill string and the wall of the bore hole to provide a jetting action which relieves a portion of the normal hydrostatic head acting on the hole bottom to thereby more nearly balance the pressure differential at the bottom of the bore hole.

Another object is to provide such an apparatus which includes a drill bit integral therewith.

Another object is to provide such an apparatus in the form of a sub which can be attached at its upper end to a drill collar and at its lower end to the drill bit.

Another object is to provide such an apparatus in which the upward jetting action is parallel to the walls of the bore hole thereby minimizing the destructive effect of such jets on the walls of the bore hole.

Other objects, advantages and features of the invention will be apparent to one skilled in the art upon consideration of the specification, including the claims, and the drawings wherein:

Figure 1:
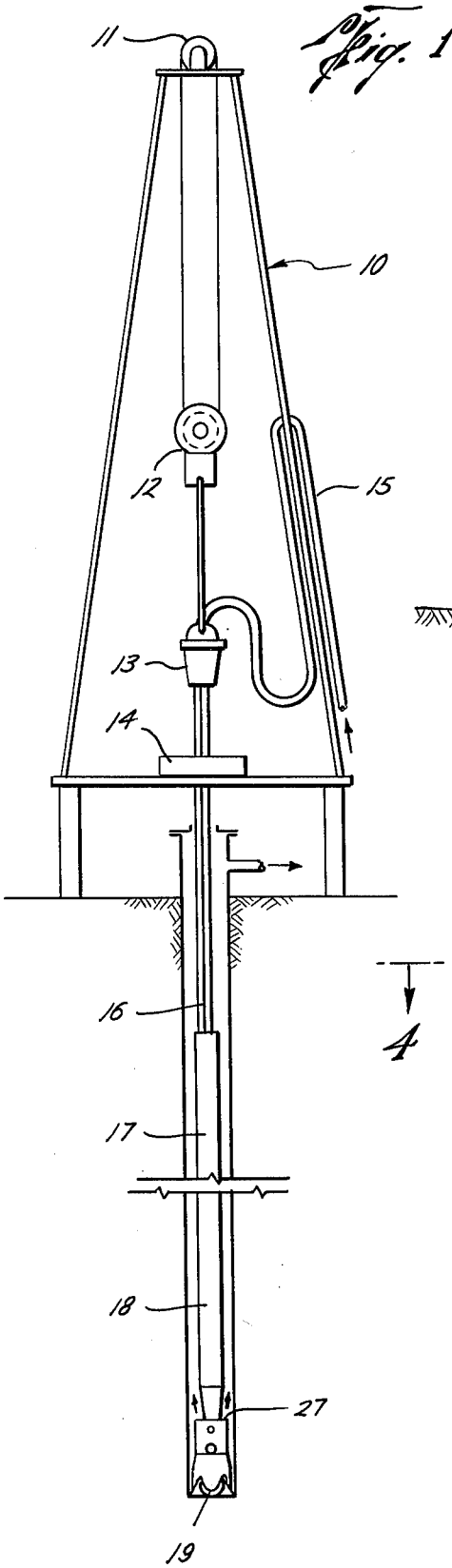
FIG. 1 is a schematic illustration of a drilling rig in the process of drilling a bore hole and showing the preferred embodiment of this invention at the lower end of the drill string.

Referring to FIG. 1, the drilling rig is equipped with a conventional crown block 11, traveling block 12, swivel 13, rotary table 14, and a mud hose 15. The drill string is likewise conventional comprising a kelly 16, drill pipe 17 and drill collars 18. As is also conventional, the drilling mud is pumped by a pump (not shown) through mud hose 15 down through the drill string to be discharged from the bit 19 after which it is circulated out of the hole through the annulus between the drill string and the wall of the bore hole.

Figure 2:
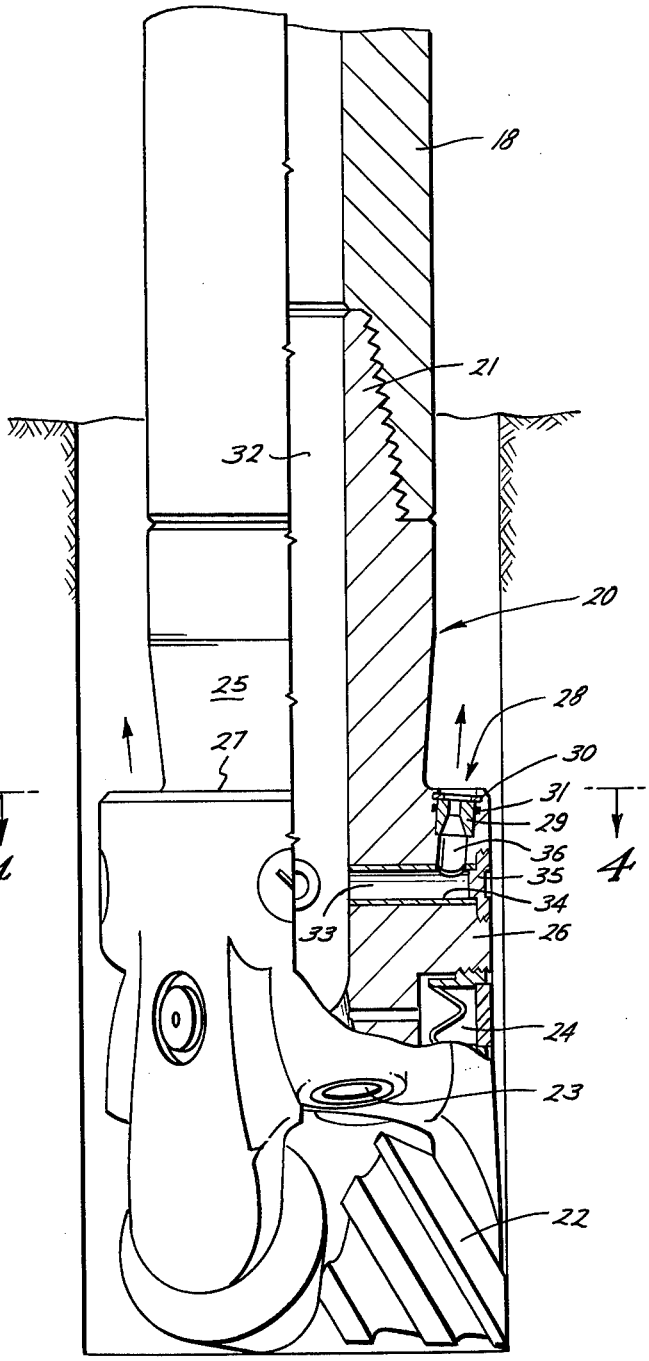
FIG. 2 is a vertical view, partially in elevation, showing the preferred embodiment of this invention.

Referring to FIG. 2, which shows a preferred embodiment of the invention, a body designated generally by the numeral 20 is provided and has a means, such as a threaded pin 21, for connecting it to a lower portion of the drill string, that is lower end of drill collar 18. In this particular embodiment, the lower end of body 20 incorporates an otherwise conventional drill bit which integrally forms the part of the body. The bit conventionally includes drill cones 22, jet nozzles 23, and a journal lubricating system 24.

Body 20 has an upper portion 25 and a lower portion 26 with the latter being enlarged and providing an upwardly facing shoulder at its upper end. A plurality of jet nozzles 28 are positioned in the shoulder 27 to discharge mud vertically upwardly along and parallel to the outer wall of body portion 25. Each jet nozzle can consist of a jet insert 29 in a counterbore extending from shoulder 27 and held in place by snap ring 30. A conventional seal such as O-ring 31 can seal between the jet insert and the wall of the counterbore to prevent mud from flowing therebetween and eroding away the snap ring.

The jet insert 29 is in communication with fluid passageway 32 through the body via a transverse passageway 33. The latter is provided by a wear insert sleeve 34 inserted in an appropriate transverse bore in body portion 26 and cemented therein by a suitable adhesive. The outer end of this bore is closed by a cap 35 whose inner end is spaced from vertical bore 36 leading to the nozzle body 29. This spacing between the entry to bore 36 and the inner face of cap 35, provides a buffer area permitting the drilling mud to change its direction without undue erosion. In this connection, the larger the size of sleeve 34, the more effective the buffer area will be in permitting the mud to make its turn into vertical bore 36.

Figure 3:
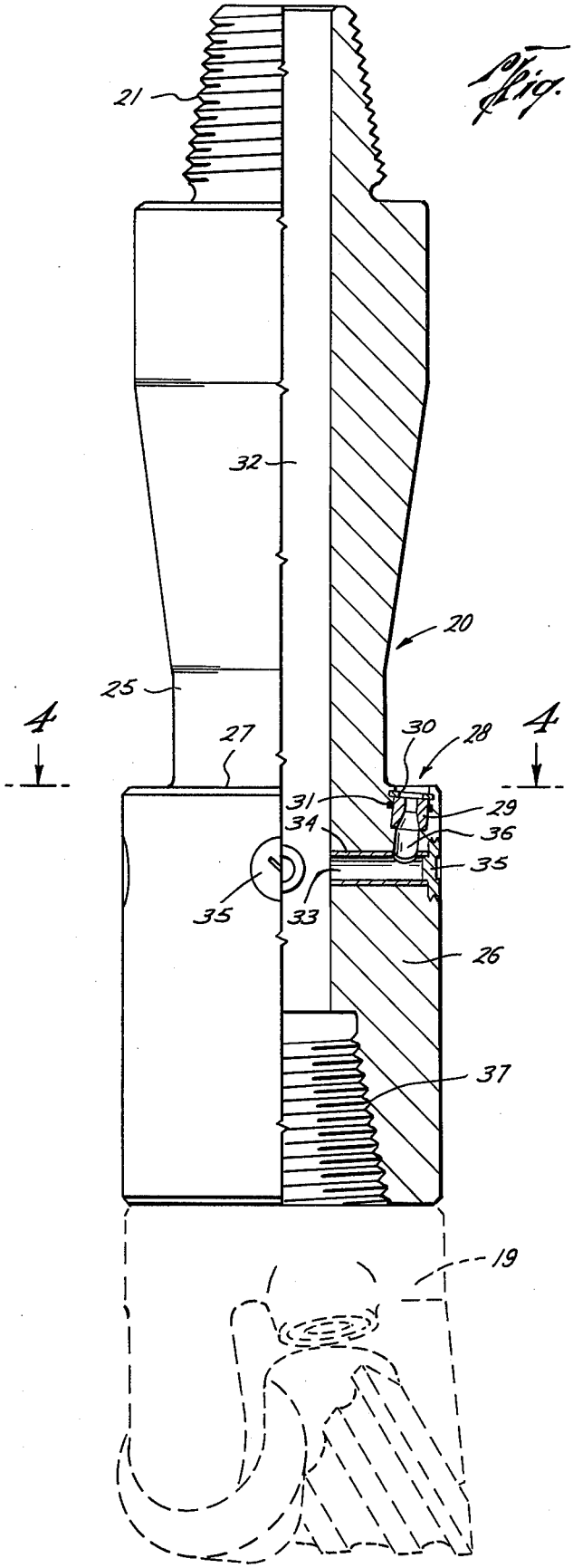
FIG. 3 is a view similar to FIG. 2 except showing the invention embodied as a sub.

Referring to FIG. 3, there is shown a sub which can be attached to the upper end of bit 19 by a means releasably connecting it thereto, such as a threaded box 37. Otherwise the construction is similar to that of FIG. 2 and like character references have been used to indicate the similar construction.

Figure 4:
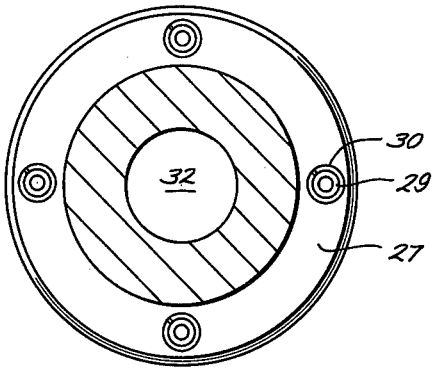
FIG. 4 is a view taken on a line 4—4 of FIG. 3.
Figure 5:
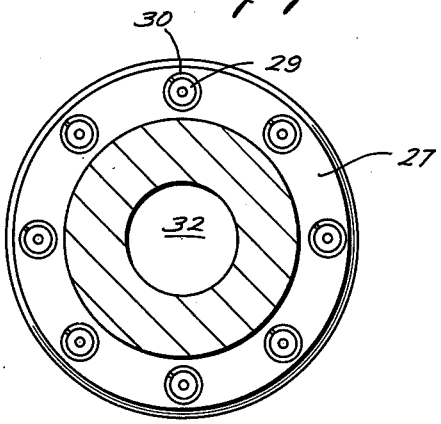
FIG. 5 is a view similar to FIG. 4 showing an arrangement incorporating a larger number of jet nozzles than that of FIG. 4.

While only four jet nozzles are shown in FIGS. 2, 3 and 4, additional ones can be used as indicated in FIG. 5. In addition to varying numbers of jet nozzles, jet inserts 29 can be replaced with others having larger or smaller jet passages therethrough thereby giving a substantial range of variability in the jetting action of the jetting apparatus.

In operation, it will be seen that a portion of the drilling mud flowing down the drill string flows out the jet nozzles of the bit in a conventional manner. However, a portion, depending upon downhole conditions, mud weight, etc., is diverted to be directed upwardly by the jet nozzles. This upward flow of drilling mud acts, in effect, as a jet lift which relieves a portion of the hydrostatic head acting on the bore hole bottom. By suitably adjusting the extent of this jetting action, one can approach or achieve balanced pressure drilling conditions.

While the shoulder 27 in which the jet nozzles are situated is shown as a continuous annular shoulder, it will be appreciated that it need not be continuous and separate shoulder portions can be provided for the individual jet nozzles.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A jetting apparatus for reducing the hydrostatic pressure exerted by drilling mud on the bottom of a bore hole while the latter is being drilled comprising a body having means to connect it to a lower part of a drill string, a rotary bit being connected to the drill string to drill the bore hole downwardly, said bit having a downwardly directed bit jet nozzles for passing mud onto the bottom of the bore hole; the body also having a mud passageway therethrough for passing mud to the bit and at least four upwardly facing shoulder portions uniformly disposed about its periphery; a body jet nozzle is each of said shoulder portions positioned to discharge mud vertically upwardly along and parallel to an upper portion of the body and also parallel to a wall of the bore hole being drilled to thereby reduce the hydrostatic mud pressure on the bottom of the bore hole; and a passageway providing fluid communication between said mud flow passageway and each said body jet nozzle to divert mud to said body jet nozzles, the number of body jet nozzles being sufficient to discharge sufficient mud to reduce the hydrostatic pressure of the drilling mud on the bottom of the bore hole to approximately the pore pressure of the formation at the bottom.

2. The apparatus of claim 1 wherein said body has means for releasably connecting the drilling bit to the body's lower end.

3. The apparatus of claim 1 wherein the lower portion of said body is the drilling bit integrally forming a part of said body.

4. A jetting apparatus for reducing the hydrostatic pressure exerted by drilling mud on the bottom of a bore hole while the latter is being drilled comprising a body having means for connecting it to a lower part of a drill string, a rotary bit being connected to the drill string to drill the bore hole downwardly, said bit having downwardly directed bit jet nozzles for passing mud onto the bottom of the bore hole, the body also having a mud passageway therethrough for passing mud to the bit, and an upper portion and a lower portion with the latter being enlarged and providing an upwardly facing shoulder at its upper end; at least four body jet nozzles uniformly disposed about said lower portion in said shoulder and positioned to discharge mud vertically upwardly along and parallel to said upper body portions to thereby reduce the hydrostatic mud pressure in the region surrounding said upper body portion; and a passageway providing fluid communication between said mud flow passageway and each said body jet nozzle to divert mud to said body jet nozzles, the number of body jet nozzles being sufficient to discharge sufficient mud to reduce the hydrostatic pressure of the drilling mud on the bottom of the bore hole to approximately the pore pressure of the formation at the bottom.

5. The apparatus of claim 4, wherein said body has releasable means for connecting the bit to its lower end.

6. The apparatus of claim 4, wherein the lower portion of said body is the drilling bit integrally forming a part of said body.

* * * * *